US010094591B2

(12) United States Patent
Garloch et al.

(10) Patent No.: US 10,094,591 B2
(45) Date of Patent: Oct. 9, 2018

(54) FURNACE CONTROL SYSTEM AND METHOD

(75) Inventors: Duane D. Garloch, Westfield, IN (US); Kevin D. Thompson, Indianapolis, IN (US)

(73) Assignee: CARRIER CORPORATION, Farmington, CT (US)

( * ) Notice: Subject to any disclaimer, the term of this patent is extended or adjusted under 35 U.S.C. 154(b) by 1821 days.

(21) Appl. No.: 13/586,045

(22) Filed: Aug. 15, 2012

(65) Prior Publication Data

US 2013/0042851 A1 Feb. 21, 2013

Related U.S. Application Data

(60) Provisional application No. 61/523,593, filed on Aug. 15, 2011.

(51) Int. Cl.

| | |
|---|---|
| ***F24H 3/02*** | (2006.01) |
| ***F24H 3/06*** | (2006.01) |
| ***F24H 9/20*** | (2006.01) |

(52) U.S. Cl.

CPC ..... *F24H 3/065* (2013.01); *F24H 9/20* (2013.01); *F24H 9/2085* (2013.01)

(58) Field of Classification Search

CPC ..... F24H 9/20; F24H 3/065
USPC ..... 126/99 R, 120
See application file for complete search history.

(56) References Cited

U.S. PATENT DOCUMENTS

| | | | | |
|---|---|---|---|---|
| 4,915,613 | A | 4/1990 | Landis et al. | |
| 5,112,217 | A | 5/1992 | Ripka et al. | |
| 5,190,452 | A | 3/1993 | Katchka et al. | |
| 5,301,654 | A | 4/1994 | Weber, III et al. | |
| 5,326,025 | A | 7/1994 | Dempsey et al. | |
| 5,340,028 | A | 8/1994 | Thompson | |
| 5,368,010 | A | 11/1994 | Weber, III et al. | |
| 5,372,120 | A * | 12/1994 | Swilik, Jr. ..... | F23N 5/242 126/116 A |
| 5,456,597 | A | 10/1995 | Lazar et al. | |
| 5,522,541 | A | 6/1996 | Zia et al. | |

(Continued)

FOREIGN PATENT DOCUMENTS

| | | |
|---|---|---|
| DE | 19847448 A1 | 4/1999 |
| JP | 5118539 | 5/1993 |
| JP | 2951465 | 6/1993 |

*Primary Examiner* — Gregory Huson
*Assistant Examiner* — Aaron Heyamoto
(74) *Attorney, Agent, or Firm* — Cantor Colburn LLP

(57) ABSTRACT

A method for operating a furnace system includes initiating a start sequence comprising starting an inducer fan operative to induce an air flow through a burner assembly, a heat exchanger portion and a collector portion, determining whether an air pressure in the collector portion is above a first threshold value, starting a furnace ignition sequence including providing fuel to the burner assembly, igniting a fuel and air mixture and starting an ignition timer responsive to determining that the air pressure in the collector portion is above the first threshold value, determining whether the ignition timer has expired, determining whether the air pressure in the collector portion is above a second threshold value responsive to determining that the ignition timer has expired, and stopping the provision of fuel to the burner assembly responsive to determining that the air pressure in the collector portion is not above the second threshold value.

17 Claims, 4 Drawing Sheets

(56) References Cited

U.S. PATENT DOCUMENTS

| | | | | |
|---|---|---|---|---|
| 5,524,556 | A | 6/1996 | Rowlette et al. | |
| 5,634,786 | A | 6/1997 | Tillander | |
| 5,732,691 | A | 3/1998 | Maiello et al. | |
| 5,775,318 | A | 7/1998 | Haydock et al. | |
| 5,860,411 | A | 1/1999 | Thompson et al. | |
| 5,993,195 | A | 11/1999 | Thompson | |
| 6,161,535 | A | 12/2000 | Dempsey et al. | |
| 6,283,115 | B1 | 9/2001 | Dempsey et al. | |
| 6,321,744 | B1 | 11/2001 | Dempsey et al. | |
| 6,401,708 | B1 | 6/2002 | Kim et al. | |
| 6,571,817 | B1 | 6/2003 | Bohan, Jr. | |
| 6,880,548 | B2 | 4/2005 | Schultz et al. | |
| 7,048,537 | B2 | 5/2006 | Jaeschke et al. | |
| 7,644,712 | B2 | 1/2010 | Schultz | |
| 7,748,375 | B2 | 7/2010 | Schultz | |
| 7,878,795 | B2 | 2/2011 | Bohan, Jr. | |
| 2003/0087213 | A1 | 5/2003 | Reifel et al. | |
| 2004/0048212 | A1 * | 3/2004 | Honda | F23N 5/242 431/24 |
| 2004/0224269 | A1 | 11/2004 | Reifel et al. | |
| 2008/0127962 | A1 | 6/2008 | Thompson | |
| 2008/0127963 | A1 | 6/2008 | Thompson | |
| 2009/0044794 | A1 | 2/2009 | Hugghins et al. | |
| 2009/0293867 | A1 | 12/2009 | Chian et al. | |
| 2009/0297997 | A1 | 12/2009 | Chian et al. | |

* cited by examiner

FURNACE CONTROL SYSTEM AND METHOD

BACKGROUND OF THE INVENTION

Many furnace systems include a control system that includes sensors, relays and control valves that are used to safely start and operate the furnace system. In operation, the furnace receives a signal to start from a thermostat. The system starts an inducer blower that creates a negative pressure in a collector box of the furnace by drawing air from a combustion air inlet and outputting air through a flue outlet. The system senses the negative pressure and starts a burner assembly in a heat exchanger portion of the system by providing fuel to the burner assembly and igniting the fuel. A blower motor may then start, such that the blower motor receives air flow from a return air duct of a space and outputs the air to the heat exchanger portion of the system. The heated air is output via a supply air duct to heat the space.

BRIEF DESCRIPTION OF THE INVENTION

According to one exemplary embodiment, a method for operating a furnace system includes receiving a start instruction at a controller, initiating a start sequence comprising starting an inducer fan operative to induce an air flow through a burner assembly, a heat exchanger portion and a collector portion, determining whether an air pressure in the collector portion is above a first threshold value, starting a furnace ignition sequence including providing fuel to the burner assembly, mixing the fuel with induced air, igniting the fuel and air mixture and starting an ignition timer responsive to determining that the air pressure in the collector portion is above the first threshold value, determining whether the ignition timer has expired, determining whether the air pressure in the collector portion is above a second threshold value responsive to determining that the ignition timer has expired, and stopping the provision of fuel to the burner assembly responsive to determining that the air pressure in the collector portion is not above the second threshold value.

According to another exemplary embodiment, a furnace system includes an inlet duct communicatively connected to an air source and a burner assembly, a heat exchanger portion communicatively connected to an output of the burner assembly, a collector portion communicatively connected to an output of the heat exchanger assembly, an inducer portion communicatively connected to an output of the collector portion and an exhaust duct, a gas valve communicatively connected to a fuel source and the burner assembly, a first pressure sensor operative to sense a pressure in the collector portion, a second pressure sensor operative to sense a second pressure in the collector portion, and a controller operative to control the gas valve, and the inducer portion, the controller operative to receive a start instruction, initiating a start sequence comprising starting the inducer portion, receive a signal from the first pressure sensor and determine whether the sensed pressure is above a first threshold value, starting a furnace ignition sequence including controlling the gas valve to provide fuel to the burner assembly and starting an ignition timer responsive to determining that an air pressure in the collector portion is above the first threshold value, determining whether the air pressure in the collector portion is above a second threshold value responsive to determining that the ignition timer has expired, and stopping the provision of fuel to the burner assembly by controlling the gas valve responsive to determining that the air pressure in the collector portion is not above the second threshold value.

According to yet another exemplary embodiment, a furnace system includes an inlet duct communicatively connected to an air source and a burner assembly, a heat exchanger portion communicatively connected to an output of the burner assembly, a collector portion communicatively connected to an output of the heat exchanger assembly, an inducer portion communicatively connected to an output of the collector portion and an exhaust duct, a gas valve communicatively connected to a fuel source and the burner assembly, a first pressure sensor operative to sense a pressure in the collector portion, a second pressure sensor operative to sense a pressure in the inducer portion, and a controller operative to control the gas valve, and the inducer portion, the controller operative to receive a start instruction, initiating a start sequence comprising starting the inducer portion, receive a signal from the first pressure sensor and determine whether the sensed pressure is above a first threshold value, starting a furnace ignition sequence including controlling the gas valve to provide fuel to the burner assembly and starting an ignition timer responsive to determining that an air pressure in the collector portion is above the first threshold value, determining whether the air pressure in the inducer portion is above a second threshold value, and stopping the provision of fuel to the burner assembly by controlling the gas valve responsive to determining that the air pressure in the inducer portion is not above the second threshold value.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
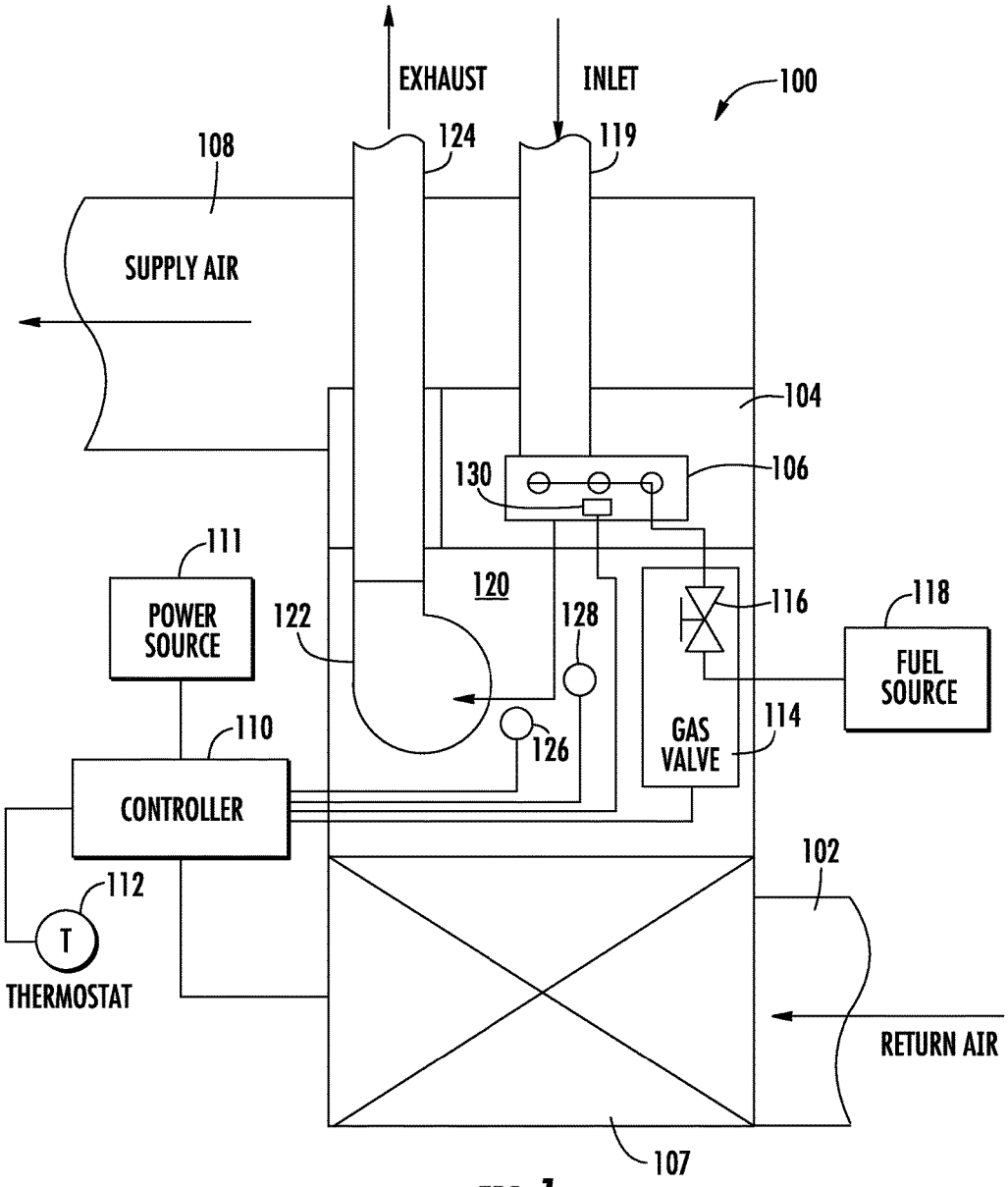
FIG. 1 illustrates an exemplary embodiment of a furnace system.

FIG. 1 illustrates an exemplary embodiment of a furnace system (system) 100. The system 100 includes a return air duct 102 that receives air from a space such as, for example, a residential or commercial structure (not shown). The air is drawn through the return air duct 102 and driven through a heat exchanger portion 104 with a blower fan 107. The air passes through the heat exchanger portion 104, which is heated by a burner assembly 106. The air exits the heat exchanger portion 104 and is output to a supply air duct 108 and sent to the space.

A controller 110 receives power from a power source 111, and controller 110 may receive signals from a device such as a thermostat 112. The controller 110 includes a logic system that may include, for example, a processor, memory, counters, timers, input devices, output devices and indicators, or other similar electronic circuitry that provides control to the system 100. The controller 110 is operative to control the blower fan 107 and send power and signals to a gas valve assembly 114. The gas valve assembly 114 includes a valve 116 that controls fuel, such as natural gas, received from a fuel source 118 and output to the burner assembly 106. The valve 116 may be controlled by, for example, a solenoid (not shown) that actuates to open the gas valve assembly 114 when power is provided to the solenoid. When the gas valve assembly 114 is opened, fuel is provided to the burner assembly 106.

The burner assembly 106 receives a flow of air via a burner inlet 119. The air from the burner inlet 119 mixes with the fuel and is ignited by an igniter (not shown) in the burner assembly 106. The product of the combustion exits the burner assembly 106 and is output to a heat exchanger portion 104, which in turn, is output to a collector portion 120. An inducer portion 122 induces a negative pressure in the collector portion 120 and draws the product of the combustion from the collector portion 120 and outputs the product of the combustion via an exhaust duct 124.

As discussed above, the gas valve assembly 114 opens the valve 116 by providing power to a solenoid. A variety of sensors or switches may be connected to the controller 110 that prevent power from being provided to the solenoid (thereby opening the valve 116 and providing fuel to the burner assembly 106) unless the sensors or switches are closed (or in a state that indicates that the sensors have sensed a parameter that is within a desired threshold). For example, prior to providing fuel to the burner assembly (i.e., opening the valve 116), the negative air pressure in the collector portion 120 should be above a threshold value that may range from, for example, 0.83 inches water column ("wc) to 0.93"wc to ensure that the burner assembly 106 is receiving air via the burner inlet 119 and that air is being output from the collector portion 120 via the exhaust duct 124. A low pressure sensor 126 is disposed in the outlet portion of the collector portion 120. The low pressure sensor 126 senses the pressure in the collector portion 120 and may close a switch (or output a signal) that indicates that the negative pressure in the collector portion 120 is above a first threshold value. The controller 110 does not send a signal to the gas valve assembly 114 to open the valve 116 unless the low pressure sensor 126 switch is closed (or a signal indicative of a pressure above the first threshold value is received). A high pressure sensor 128 may be located in the collector portion 120 (or the inducer portion 122 as described below in FIG. 2). The high pressure sensor 128 senses the air pressure in the collector portion 120 or the inducer portion 122 and activates a switch (or outputs a signal) that indicates that the pressure in the collector portion 120 or inducer portion 122 is above a second pressure threshold value. The second threshold value may include, for example, a value of ranging between approximately 0.45"wc to 0.50"wc in embodiments where the high pressure sensor is located in the inducer portion 122, and a value of approximately 1.00"wc to 1.40"wc where the high pressure sensor 128 is located in the collector portion 120. If the pressure in the collector portion 120 or inducer portion 122 is below the threshold value, the controller 110 may tell the gas valve assembly 114 to close the valve 116 to stop the flow of fuel to the burner assembly 106. Other sensors or switches, such as, for example, a flame sensor 130 and limit switches (not shown) may also provide signals to the controller 110 to facilitate safe operation of the system 100.

The arrangement of the low pressure sensor 126 and the high pressure sensor 128 facilitate the safe starting and operation of the system 100 when the pressure in the collector portion 120 or inducer portion 122 is not above a second threshold value prior to fuel ignition, while maintaining efficient operation of the inducer portion 122. Using the low pressure sensor 126 and the high pressure sensor 128, the system may be started while ensuring that the air pressure in the collector portion 120 is above a first threshold value. Once a timer has expired, the system may run while ensuring that the air pressure in the collector portion 120 or inducer portion 122 is above a second threshold value.

Figure 2:
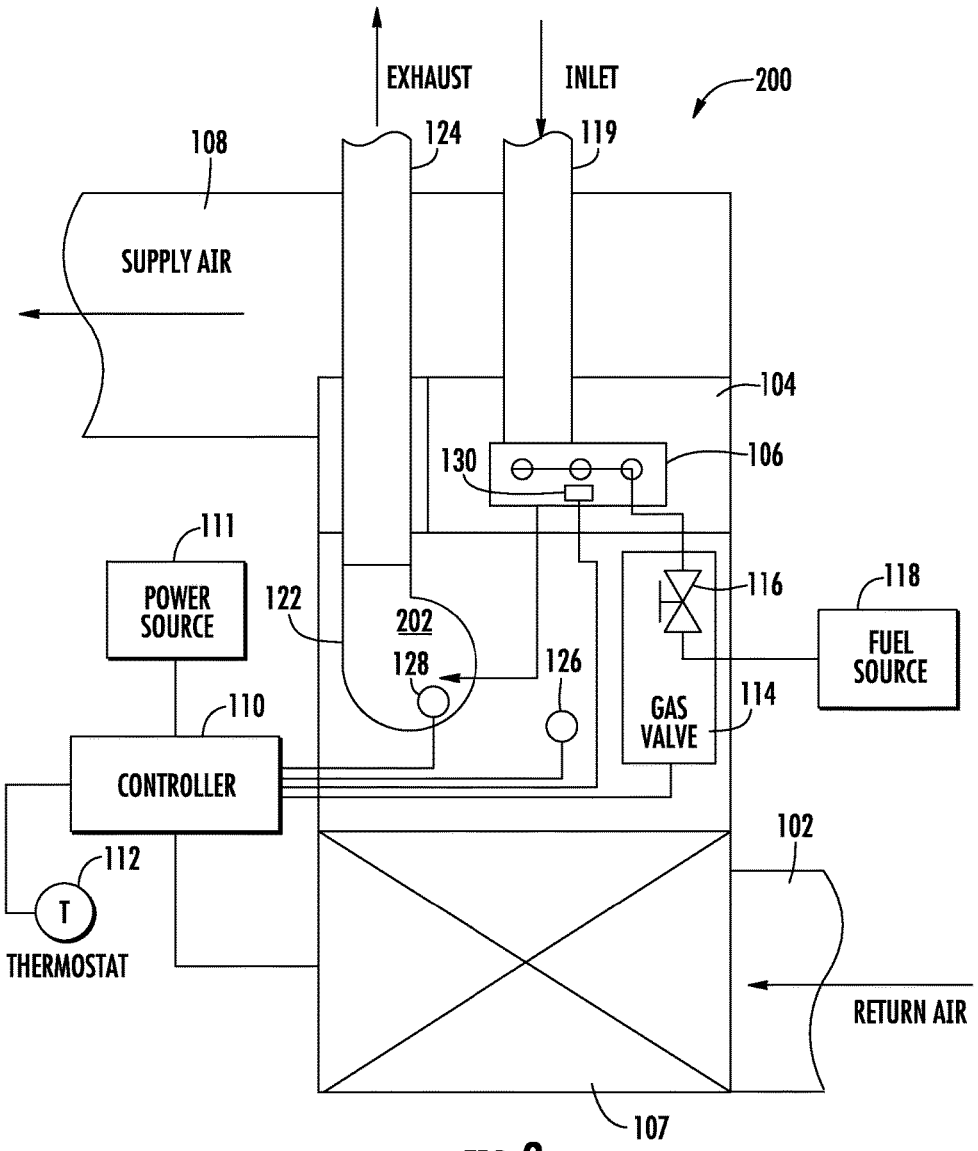
FIG. 2 illustrates an alternate exemplary embodiment of a furnace system.

FIG. 2 illustrates an alternate exemplary embodiment of a system 200. The system 200 is similar to the system 100 (of FIG. 1) described above, however the high pressure sensor 128 is disposed in the inducer portion 122. In this regard, the high pressure sensor 128 detects or measures a negative pressure in a portion of the inducer portion 122. In the illustrated embodiment, the inducer portion 122 includes a cavity 202 that defines a flow path and induces a negative pressure on the air from the collector portion using a fan or wheel assembly (not shown). The high pressure sensor 128 may measure the negative pressure in the cavity 202. In the systems and methods described herein, the operation of the systems 100 and 200 are similar, however, the thresholds associated with the high pressure sensor 128 may differ to correspond to the location of the high pressure sensor 128 in the systems.

Figure 3A:
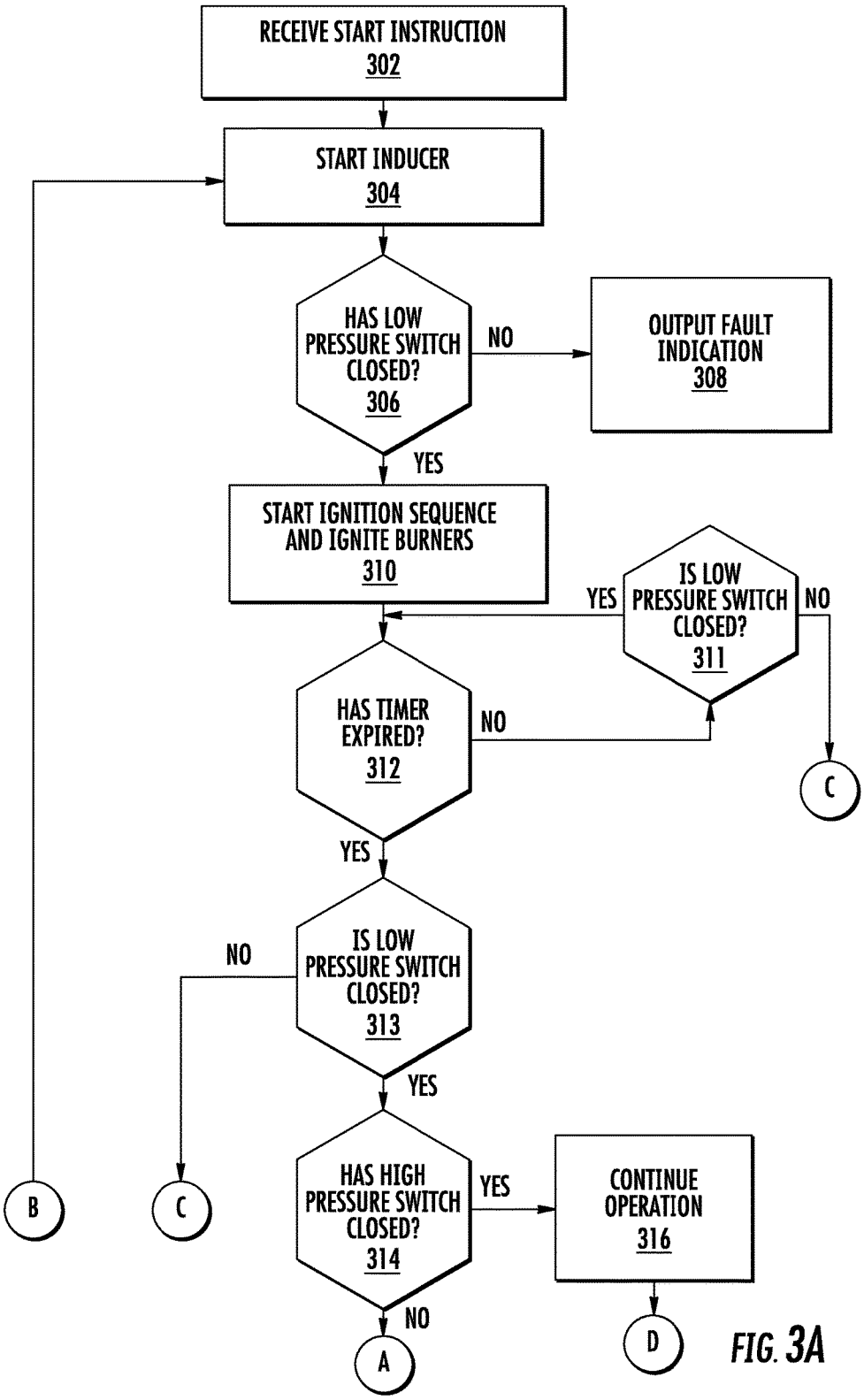
FIGS. 3A-3B illustrate a block diagram of an exemplary method for controlling the systems of FIGS. 1 and 2.
Figure 3B:
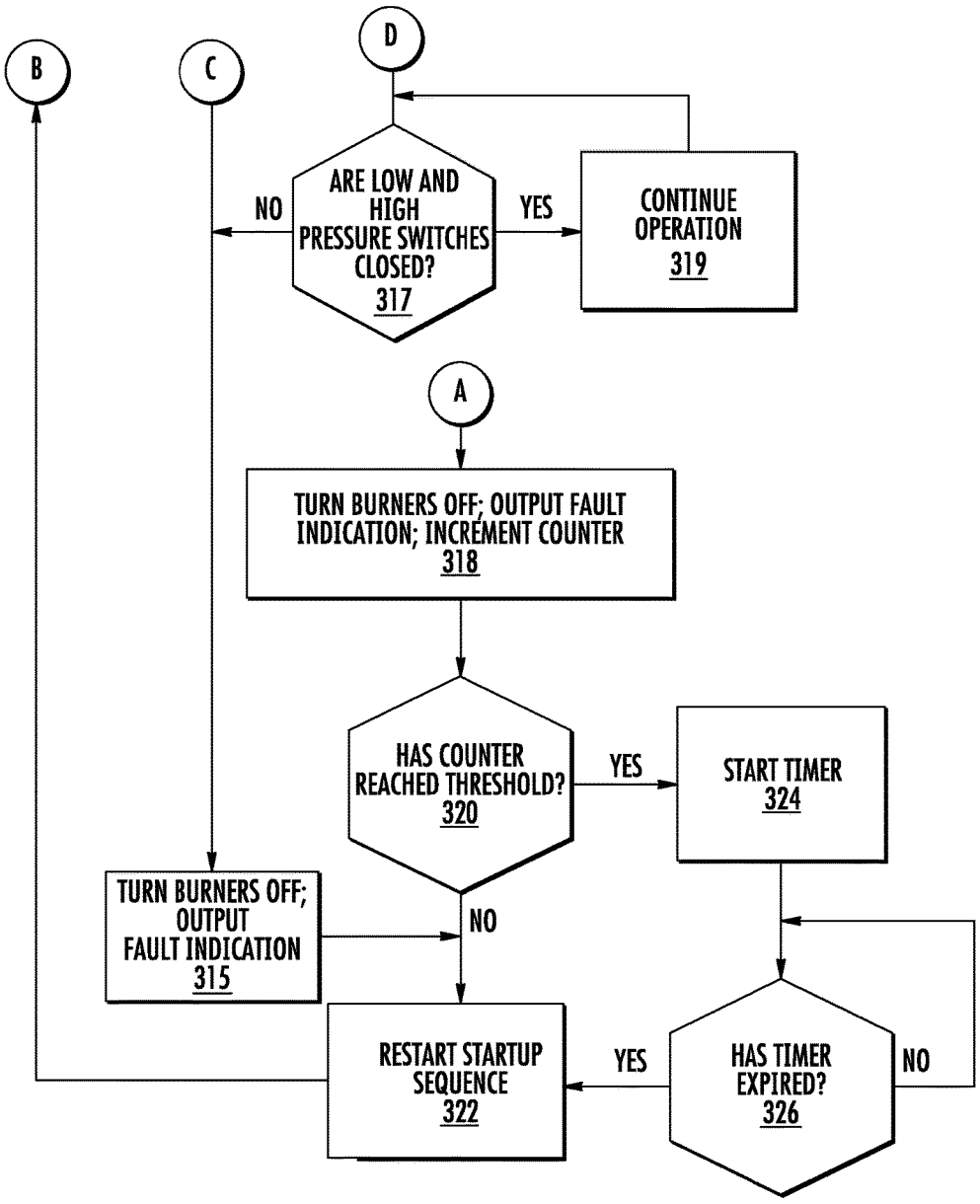

FIGS. 3A-3B illustrate a block diagram of an exemplary method for controlling the systems 100 and 200 (of FIGS. 1 and 2). Referring to FIG. 3A, in block 302, the controller 110 receives a start instruction. The start instruction may be received from, for example, the thermostat 112. In block 304 the controller sends power to the inducer portion 122. In block 306, once the negative pressure in the collector portion 120 is above a threshold value, the low pressure sensor 126 switch closes. If the low pressure sensor 126 switch does not close within a threshold time period, the controller 110 may output a fault indication in block 308. If the low pressure sensor 126 switch closes, in block 310, the ignition sequence starts and the burner assembly 106 is ignited. The ignition sequence includes, for example, the opening of the valve 116, the actuation of an igniter (not shown) and the combustion of the fuel and air mixture in the burner assembly 106. The ignition sequence may also include starting the blower fan 107 and the starting of an ignition timer. In block 312, the controller 110 determines whether the ignition timer has expired. In the illustrated embodiment, the ignition timer is set to approximately one minute; however, the ignition timer in alternate embodiments may be set for any appropriate time period. In block 311, the controller 110 monitors the low pressure sensor 126 prior to the ignition timer expiring. If the low pressure switch is no longer closed, the burners are turned off and a fault indication is output in block 315 (of FIG. 3B). Once the ignition timer has expired, the controller 110 determines whether the low pressure sensor 126 switch is still closed in block 313. If yes, the controller 110 determines whether the high pressure sensor 128 switch has closed in block 314. The high pressure sensor 128 senses the air pressure in the collector portion 120 (or the inducer portion 122, in the system 200) to determine whether the pressure is above a second threshold value. If yes, the system continues operation in block 316. Referring to FIG. 3B, in block 318, if the high pressure sensor 128 switch is open, the burners are turned off, a fault indication may be sent, and a fault counter is incremented. In block 320, the controller 110 determines whether the fault counter has reached a threshold fault value. In the illustrated embodiment, the threshold fault value is three faults; however, alternate embodiments may include a threshold fault value of any appropriate number of faults. If no, the start sequence is restarted in block 322. If yes, a fault timer is started in block 324. In block 326, the controller 110 determines whether the fault timer has expired. If yes, the startup sequence is restarted in block 322. The fault timer may run for any desired time period, such as, for example 3-4 hours. In block 317, the high pressure sensor 128 and the low pressure sensor 126 switches are closed, operation continues in block 319. If either of the high pressure sensor 128 or the low pressure sensor 126 switches is open, the burner assembly 106 is extinguished, and a fault indication is output in box 315.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method for operating a furnace system, the method comprising:
- receiving a start instruction at a controller;
- initiating a start sequence comprising:
  - starting an inducer fan operative to induce an air flow through a burner assembly, a heat exchanger portion and a collector portion;
  - comparing an air pressure to a first threshold value;
  - starting a furnace ignition sequence including providing fuel to the burner assembly, mixing the fuel with induced air, igniting the fuel and air mixture and starting an ignition timer responsive to determining that the air pressure is above the first threshold value;
  - determining whether the ignition timer has expired;
  - determining whether the air pressure is above a second threshold value responsive to determining that the ignition timer has expired; and
  - stopping the provision of fuel to the burner assembly responsive to determining that the air pressure is not above the second threshold value;
  - wherein the first threshold value is less than the second threshold value.

2. The method of claim 1, wherein the method further comprises outputting a fault indicator responsive to determining that the air pressure is not above the first threshold value.

3. The method of claim 1, wherein the method further comprises stopping the provision of fuel to the burner assembly responsive to determining that the air pressure is not above the first threshold value.

4. The method of claim 1, wherein the method further comprises sending a fault indication responsive to determining that the air pressure is not above the second threshold value.

5. The method of claim 1, wherein the method further comprises:
- incrementing a fault counter responsive to determining that the air pressure is not above the second threshold value;
- determining whether the fault counter has reached a fault counter threshold value; and
- initiating the start sequence responsive to determining that the fault counter has not reached the fault counter threshold value.

6. The method of claim 1, wherein the air pressure comprises air pressure in the collector portion.

7. The method of claim 1, wherein determining that the air pressure is above the first threshold value is based on air pressure in the collector portion and determining whether the air pressure is above the second threshold value is based on air pressure in an inducer portion.

8. The method of claim 1, wherein the air pressure comprises air pressure in at least one of the collector portion and an inducer portion.

9. A method for operating a furnace system, the method comprising:
- receiving a start instruction at a controller;
- initiating a start sequence comprising:
  - starting an inducer fan operative to induce an air flow through a burner assembly, a heat exchanger portion and a collector portion;
  - comparing an air pressure to a first threshold value;
  - starting a furnace ignition sequence including providing fuel to the burner assembly, mixing the fuel with induced air, igniting the fuel and air mixture and starting an ignition timer responsive to determining that the air pressure is above the first threshold value;
  - determining whether the ignition timer has expired;
  - determining whether the air pressure is above a second threshold value responsive to determining that the ignition timer has expired;
  - stopping the provision of fuel to the burner assembly responsive to determining that the air pressure is not above the second threshold value;
  - incrementing a fault counter responsive to determining that the air pressure is not above the second threshold value;
  - determining whether the fault counter has reached a fault counter threshold value; and
  - initiating the start sequence responsive to determining that the fault counter has not reached the fault counter threshold value;
  - starting a fault timer responsive to determining that the fault counter has reached the fault counter threshold value;
  - determining whether the fault timer has expired; and
  - initiating the start sequence responsive to determining that the fault timer has expired.

10. A furnace system comprising:
- an inlet duct communicatively connected to an air source and a burner assembly;
- a heat exchanger portion communicatively connected to an output of the burner assembly;
- a collector portion communicatively connected to an output of the heat exchanger assembly;
- an inducer portion communicatively connected to an output of the collector portion and an exhaust duct;
- a gas valve communicatively connected to a fuel source and the burner assembly;
- a first pressure sensor operative to sense a pressure in the collector portion;
- a second pressure sensor operative to sense a second pressure in the collector portion; and
- a controller operative to control the gas valve, and the inducer portion, the controller operative to receive a start instruction, initiating a start sequence comprising starting the inducer portion, receive a signal from the first pressure sensor and determine whether the sensed pressure is above a first threshold value, starting a furnace ignition sequence including controlling the gas valve to provide fuel to the burner assembly and starting an ignition timer responsive to determining that an air pressure in the collector portion is above the first threshold value, determining whether the air pressure in the collector portion is above a second threshold value, and stopping the provision of fuel to the burner assembly by controlling the gas valve responsive to determining that the air pressure in the collector portion is not above the second threshold value;

wherein the first threshold value is less than the second threshold value.

11. The system of claim 10, wherein the start sequence further comprises outputting a fault indicator responsive to determining that the air pressure in the collector portion is not above the first threshold value.

12. The system of claim 10, wherein the start sequence further comprises stopping the provision of fuel to the burner assembly responsive to determining that the air pressure in the collector portion is not above the first threshold value.

13. The system of claim 10, wherein the start sequence further comprises outputting a fault indication responsive to determining that the air pressure in the collector portion is not above the second threshold value.

14. A furnace system comprising:

an inlet duct communicatively connected to an air source and a burner assembly;

a heat exchanger portion communicatively connected to an output of the burner assembly;

a collector portion communicatively connected to an output of the heat exchanger assembly;

an inducer portion communicatively connected to an output of the collector portion and an exhaust duct;

a gas valve communicatively connected to a fuel source and the burner assembly;

a first pressure sensor operative to sense a pressure in the collector portion;

a second pressure sensor operative to sense a pressure in the inducer portion; and a controller operative to control the gas valve, and the inducer portion, the controller operative to receive a start instruction, initiating a start sequence comprising starting the inducer portion, receive a signal from the first pressure sensor and determine whether the sensed pressure is above a first threshold value, starting a furnace ignition sequence including controlling the gas valve to provide fuel to the burner assembly and starting an ignition timer responsive to determining that an air pressure in the collector portion is above the first threshold value, determining whether the air pressure in the inducer portion is above a second threshold value, and stopping the provision of fuel to the burner assembly by controlling the gas valve responsive to determining that the air pressure in the inducer portion is not above the second threshold value;

wherein the first threshold value is less than the second threshold value.

15. The system of claim 14, wherein the start sequence further comprises outputting a fault indicator responsive to determining that the air pressure in the collector portion is not above the first threshold value.

16. The system of claim 14, wherein the start sequence further comprises stopping the provision of fuel to the burner assembly responsive to determining that the air pressure in the collector portion is not above the first threshold value.

17. The system of claim 14, wherein the start sequence further comprises outputting a fault indication responsive to determining that the air pressure in the collector portion is not above the second threshold value.

* * * * *